US010227848B2

(12) United States Patent
Castro et al.

(10) Patent No.: US 10,227,848 B2
(45) Date of Patent: Mar. 12, 2019

(54) TREATMENT TOOL FOR USE IN A SUBTERRANEAN WELL

(71) Applicant: WEATHERFORD TECHNOLOGY HOLDINGS, LLC, Houston, TX (US)

(72) Inventors: Candido Castro, Richmond, TX (US); Joshua M. Hornsby, Tomball, TX (US); Brian J. Ritchey, Hockley, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 299 days.

(21) Appl. No.: 15/052,207

(22) Filed: Feb. 24, 2016

(65) Prior Publication Data

US 2017/0241235 A1 Aug. 24, 2017

(51) Int. Cl.

| | |
|---|---|
| ***E21B 43/04*** | (2006.01) |
| ***E21B 34/14*** | (2006.01) |
| ***E21B 34/12*** | (2006.01) |
| ***E21B 43/08*** | (2006.01) |
| ***E21B 43/25*** | (2006.01) |
| *E21B 34/00* | (2006.01) |

(52) U.S. Cl.

CPC ..... *E21B 43/04* (2013.01); *E21B 34/12* (2013.01); *E21B 34/14* (2013.01); *E21B 43/08* (2013.01); *E21B 43/25* (2013.01); *E21B 2034/007* (2013.01)

(58) Field of Classification Search

CPC ..... E21B 43/045; E21B 43/04; E21B 34/14
See application file for complete search history.

(56) References Cited

U.S. PATENT DOCUMENTS

| | | | | |
|---|---|---|---|---|
| 3,072,204 | A * | 1/1963 | Brown | E21B 43/045 166/120 |
| 6,702,020 | B2 | 3/2004 | Zachman et al. | |
| 6,725,929 | B2 | 4/2004 | Bissonnette et al. | |
| 2002/0195253 | A1 | 12/2002 | Hill, Jr. et al. | |
| 2011/0067862 | A1 | 3/2011 | Clem et al. | |

FOREIGN PATENT DOCUMENTS

| | | |
|---|---|---|
| WO | 2016/108886 | 7/2016 |

OTHER PUBLICATIONS

Australian Examination Report dated Mar. 27, 2018 for AU Patent Application No. 2017200618, 7 pages.
Combined Search and Examination Report dated Jun. 1, 2017 for UK Patent Application No. GB1701641.1, 5 pages.

* cited by examiner

*Primary Examiner* — D. Andrews
(74) *Attorney, Agent, or Firm* — Smith IP Services, P.C.

(57) ABSTRACT

A treatment tool can include a housing with longitudinal passages, a valve that controls flow between sections of one passage, another valve that controls flow between the one passage and a section of another passage, and a locking device that prevents the first valve from being transitioned to an open configuration from a closed configuration. A method can include flowing a fluid through a passage of a service string and into an annulus about a screen, the fluid entering the screen and flowing to another annulus via another passage of the service string, then installing a plug in the first passage, thereby preventing flow through the first passage to the annulus about the screen, and creating at least one pressure differential across the plug, thereby preventing flow from an interior of the screen to the other annulus and permitting flow from the first passage to the screen interior.

14 Claims, 16 Drawing Sheets

TREATMENT TOOL FOR USE IN A SUBTERRANEAN WELL

BACKGROUND

This disclosure relates generally to equipment and operations utilized in conjunction with subterranean wells and, in an example described below, more particularly provides a well treatment tool and associated systems and methods.

Although variations are possible, a gravel pack is generally an accumulation of "gravel" (typically sand, proppant or another granular or particulate material, whether naturally occurring or synthetic) about a tubular filter or screen in a wellbore. The gravel is sized, so that it will not pass through the screen, and so that sand, debris and fines from an earth formation penetrated by the wellbore will not easily pass through the gravel pack with fluid flowing from the formation. Although relatively uncommon, a gravel pack may also be used in an injection well, for example, to support an unconsolidated formation.

Placing the gravel about the screen in the wellbore is a complicated process, requiring relatively sophisticated equipment and techniques to maintain well integrity while ensuring the gravel is properly placed in a manner that provides for subsequent efficient and trouble-free operation. It will, therefore, be readily appreciated that improvements are continually needed in the arts of designing and utilizing gravel pack equipment and methods.

Such improved equipment and methods may be useful with any type of gravel pack in cased or open wellbores, and in vertical, horizontal or deviated well sections. The improved equipment and methods may also be useful in well operations other than gravel packing (such as, injection operations, stimulation operations, drilling operations, etc.).

DETAILED DESCRIPTION

Figure 1:
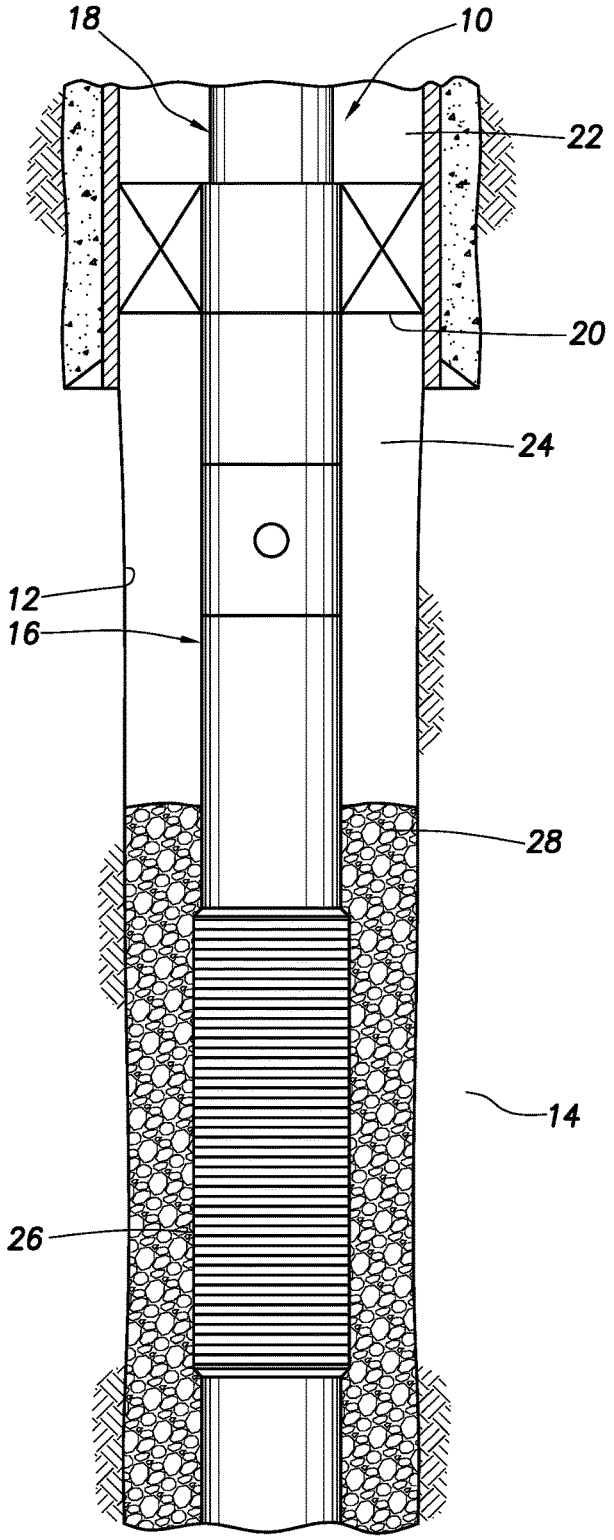
FIG. 1 is a representative partially cross-sectional view of an example of a gravel pack system and associated method which can embody principles of this disclosure.

Representatively illustrated in FIG. 1 is a gravel pack system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled, so that it penetrates an earth formation 14. A well completion assembly 16 is installed in the wellbore 12, for example, using a generally tubular service string 18 to convey the completion assembly and set a packer 20 of the completion assembly.

Setting the packer 20 in the wellbore 12 provides for isolation of an upper well annulus 22 from a lower well annulus 24 (although, as described above, at the time the packer is set, the upper annulus and lower annulus may be in communication with each other). The upper annulus 22 is formed radially between the service string 18 and the wellbore 12, and the lower annulus 24 is formed radially between the completion assembly 16 and the wellbore.

The terms "upper" and "lower" are used herein for convenience in describing the relative orientations of the annulus 22 and annulus 24 as they are depicted in FIG. 1. In other examples, the wellbore 12 could be horizontal (in which case neither of the annuli would be above or below the other) or otherwise deviated. Thus, the scope of this disclosure is not limited to any relative orientations of examples as described herein.

As depicted in FIG. 1, the packer 20 is set in a cased portion of the wellbore 12, and a generally tubular well screen 26 of the completion assembly 16 is positioned in an uncased or open hole portion of the wellbore. However, in other examples, the packer 20 could be set in an open hole portion of the wellbore 12, and/or the screen 26 could be positioned in a cased portion of the wellbore. Thus, it will be appreciated that the scope of this disclosure is not limited to any particular details of the system 10 as depicted in FIG. 1, or as described herein.

In the FIG. 1 method, the service string 18 not only facilitates setting of the packer 20, but also provides a variety of flow passages for directing fluids to flow into and out of the completion assembly 16, the upper annulus 22 and the lower annulus 24. One reason for this flow directing function of the service string 18 is to deposit gravel 28 in the lower annulus 24 about the well screen 26.

Examples of some steps of the method are representatively depicted in FIGS. 2-7 and are described more fully below. However, it should be clearly understood that it is not necessary for all of the steps depicted in FIGS. 2-7 to be performed, and additional or other steps may be performed, in keeping with the principles of this disclosure.

Figure 2:
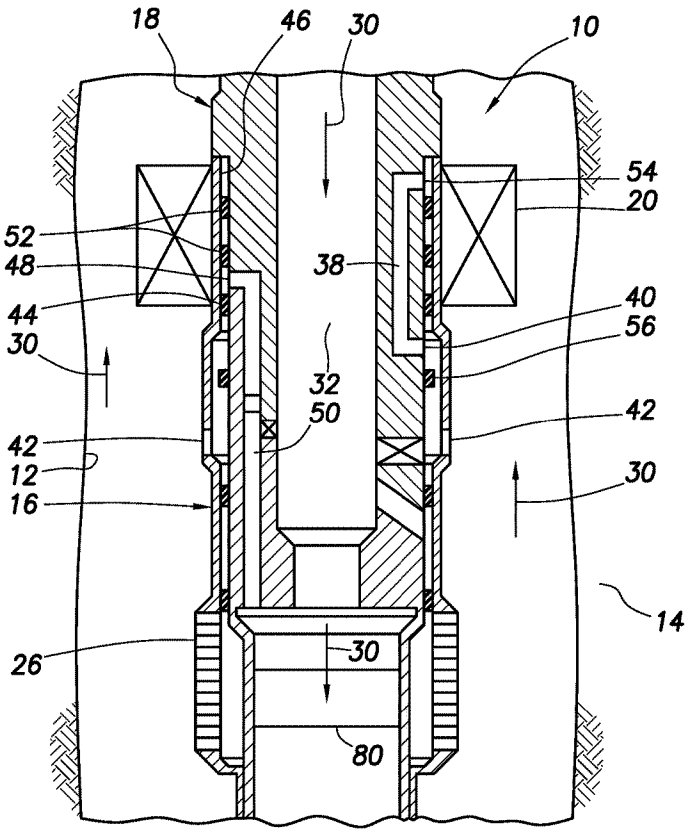

Referring now to FIG. 2, the system 10 is depicted as the service string 18 is being used to convey and position the completion assembly 16 in the wellbore 12. For clarity of illustration, the cased portion of the wellbore 12 is not depicted in FIGS. 2-7.

Note that, as shown in FIG. 2, the packer 20 is not yet set, and so the completion assembly 16 can be displaced through the wellbore 12 to any desired location. As the completion assembly 16 is displaced into the wellbore 12 and positioned therein, a fluid 30 can be circulated through a flow passage 32 that extends longitudinally through the service string 18. The fluid 30 can flow through an open valve assembly 80 of the service string 18.

Figure 3:
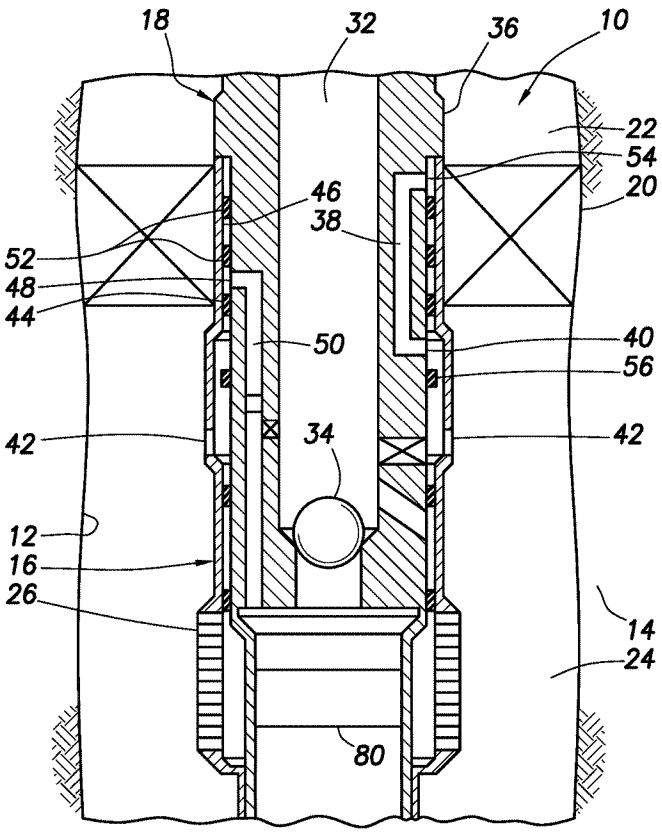
FIGS. 2-7 are representative cross-sectional views of a succession of steps in the method of gravel packing.

As depicted in FIG. 3, the completion assembly 16 has been appropriately positioned in the wellbore 12, and the packer 20 has been set to thereby provide for isolation between the upper annulus 22 and the lower annulus 24. In this example, to accomplish setting of the packer 20, a ball, dart or other plug 34 is deposited in the flow passage 32 and, after the plug 34 seals off the flow passage, pressure in the flow passage above the plug is increased.

This increased pressure operates a packer setting tool 36 of the service string 18. The setting tool 36 can be of the type well known to those skilled in the art, and so further details of the setting tool and its operation are not illustrated in the drawings or described herein.

Although the packer 20 in this example is set by application of increased pressure to the setting tool 36 of the service string 18, in other examples the packer may be set using other techniques. For example, the packer 20 could be set by manipulation of the service string 18 (e.g., rotating in a selected direction and then setting down or pulling up, etc.), with or without application of increased pressure. Thus, the scope of this disclosure is not limited to any particular technique for setting the packer 20.

Note that, although the set packer 20 separates the upper annulus 22 from the lower annulus 24, in the step of the method as depicted in FIG. 3, the upper annulus and lower annulus are not yet fully isolated from each other. Instead, another flow passage 38 in the service string 18 provides for fluid communication between the upper annulus 22 and the lower annulus 24.

In FIG. 3, it may be seen that a lower port 40 permits communication between the flow passage 38 and an interior of the completion assembly 16. Openings 42 formed through the completion assembly 16 permit communication between the interior of the completion assembly and the lower annulus 24. The valve assembly 80 remains in its open configuration.

An annular seal 44 is sealingly received in a seal bore 46. The seal bore 46 is located within the packer 20 in this example, but in other examples, the seal bore could be otherwise located (e.g., above or below the packer).

In the step as depicted in FIG. 3, the seal 44 isolates the port 40 from another port 48 that provides communication between another flow passage 50 and an exterior of the service string 18. At this stage of the method, no flow is permitted through the port 48, because one or more additional annular seals 52 on an opposite longitudinal side of the port 48 are also sealingly received in the seal bore 46.

An upper end of the flow passage 38 is in communication with the upper annulus 22 via an upper port 54. Although not clearly visible in FIG. 3, relatively small annular spaces between the setting tool 36 and the packer 20 provide for communication between the port 54 and the upper annulus 22.

Thus, it will be appreciated that the flow passage 38 and ports 40, 54 effectively bypass the seal bore 46 (which is engaged by the annular seals 44, 52 carried on the service string 18) and allow for hydrostatic pressure in the upper annulus 22 to be communicated to the lower annulus 24. This enhances wellbore 12 stability, in part by preventing pressure in the lower annulus 24 from decreasing (e.g., toward pressure in the formation 14) when the packer 20 is set.

Figure 4:
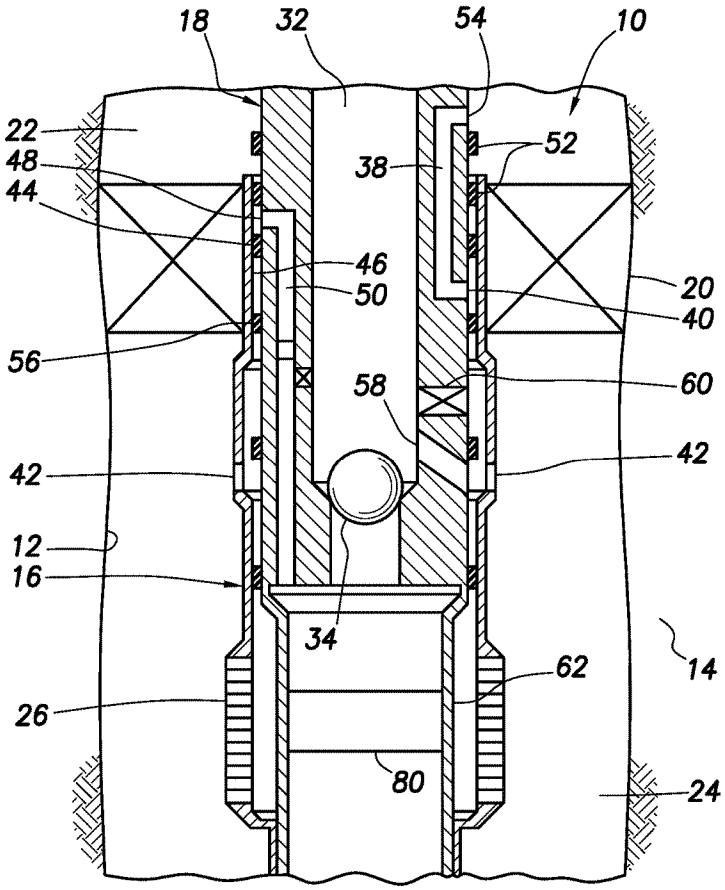

As depicted in FIG. 4, the service string 18 has been raised relative to the completion string 16, which is now secured to the wellbore 12 due to previous setting of the packer 20. In this position, another annular seal 56 carried on the service string 18 is now sealingly engaged in the seal bore 46, thereby isolating the flow passage 38 from the lower annulus 24.

However, the flow passage 32 is now in communication with the lower annulus 24 via the openings 42 and one or more ports 58 in the service string 18. Thus, hydrostatic pressure continues to be communicated to the lower annulus 24. The valve assembly 80 remains in its open configuration.

The lower annulus 24 is isolated from the upper annulus 22 by the packer 20. The flow passage 38 is not in communication with the lower annulus 24 due to the annular seal 56 in the seal bore 46. The flow passage 50 may be in communication with the lower annulus 24, but no flow is permitted through the port 48 due to the annular seal 52 in the seal bore 46. Thus, the lower annulus 24 is isolated completely from the upper annulus 22.

In the FIG. 4 position of the service string 18, the packer 20 can be tested by applying increased pressure to the upper annulus 22 (for example, using surface pumps). If there is any leakage from the upper annulus 22 to the lower annulus 24, this leakage will be transmitted via the openings 42 and ports 58 to surface via the flow passage 32, so it will be apparent to operators at surface and remedial actions can be taken.

Figure 5:
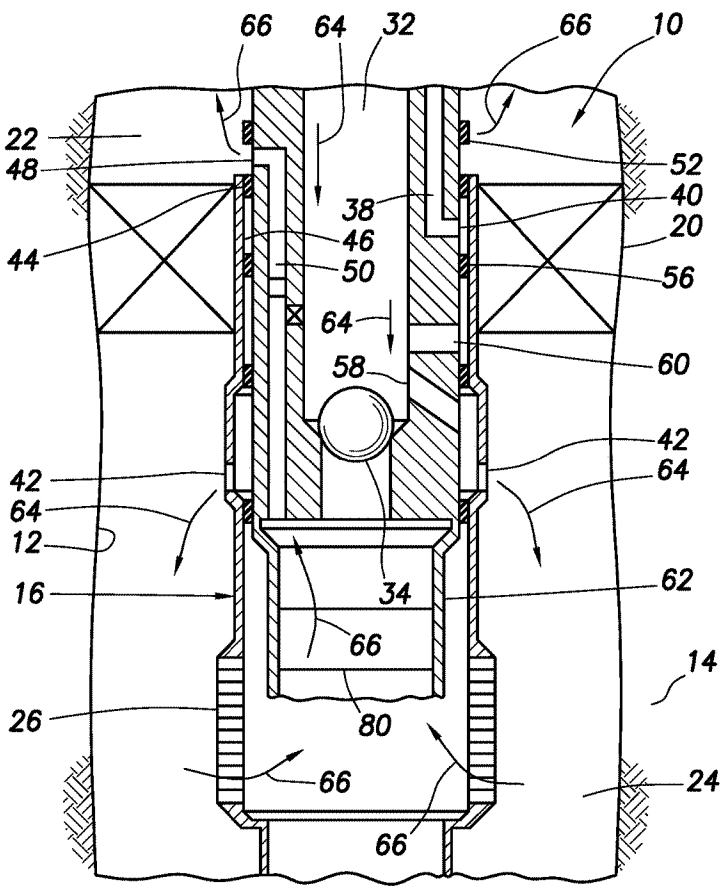

As depicted in FIG. 5, a reversing valve 60 has been opened by raising the service string 18 relative to the completion assembly 16, so that the annular seal 56 is above the seal bore 46, and then applying pressure to the upper annulus 22 to open the reversing valve. The service string 18 is then lowered to its FIG. 5 position (which is raised somewhat relative to its FIG. 4 position).

Thus, in this example, the reversing valve 60 is an annular pressure-operated sliding sleeve valve of the type well known to those skilled in the art, and so operation and construction of the reversing valve is not described or illustrated in more detail by this disclosure. However, it should be clearly understood that the scope of this disclosure is not limited to use of any particular type of reversing valve, or to any particular technique for operating a reversing valve.

The raising of the service string 18 relative to the completion assembly 16 can facilitate operations other than opening of the reversing valve 60. In this example, the raising of the service string 18 can function to close a valve assembly 80 connected in or below a washpipe 62 of the service string, as described more fully below. The valve assembly 80 can (when closed) substantially or completely prevent flow from the flow passage 32 into an interior of the well screen 26.

In the FIG. 5 position, the flow passage 32 is in communication with the lower annulus 24 via the openings 42 and ports 58. In addition, the flow passage 50 is in communication with the upper annulus 22 via the port 48. The flow passage 50 is also in communication with an interior of the well screen 26 via the washpipe 62.

A gravel slurry 64 (a mixture of the gravel 28 and one or more fluids 66) can now be flowed from surface through the flow passage 32 of the service string 18, and outward into the lower annulus 24 via the openings 42 and ports 58. The fluids 66 can flow inward through the well screen 26, into the washpipe 62, and to the upper annulus 22 via the flow passage 50 for return to surface. In this manner, the gravel 28 is deposited into the lower annulus 24 (see FIGS. 6 & 7).

Figure 6:
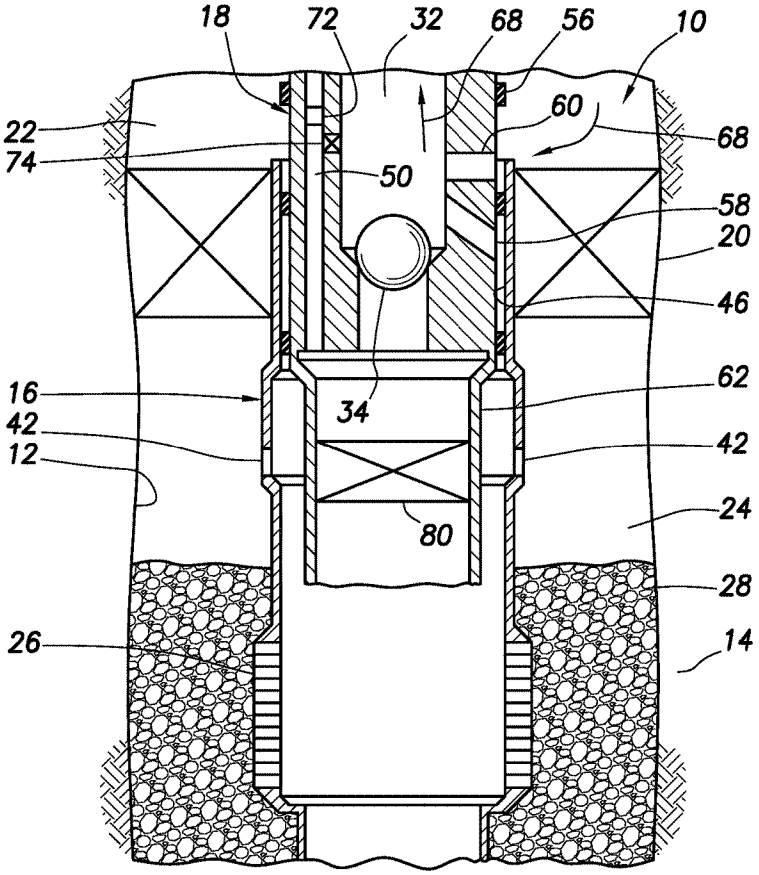

As depicted in FIG. 6, the service string 18 has been raised further relative to the completion assembly 16 after the gravel slurry 64 pumping operation is concluded. The annular seal 56 is now out of the seal bore 46, thereby exposing the reversing valve 60 again to the upper annulus 22. The valve assembly 80 is in its closed configuration.

A clean fluid 68 can now be circulated from surface via the upper annulus 22 and inward through the open reversing valve 60, and then back to surface via the flow passage 32. This reverse circulating flow can be used to remove any gravel 28 remaining in the flow passage 32 after the gravel slurry 64 pumping operation.

After reverse circulating, the service string 18 can be conveniently retrieved to surface and a production tubing string (not shown) can be installed. Flow through the openings 42 is prevented when the service string 18 is withdrawn from the completion assembly 16 (e.g., by shifting a sleeve of the type known to those skilled in the art as a closing sleeve). A lower end of the production tubing string can be equipped with annular seals and stabbed into the seal bore 46, after which fluids can be produced from the formation 14 through the gravel 28, then into the well screen 26 and to surface via the production tubing string.

Figure 7:
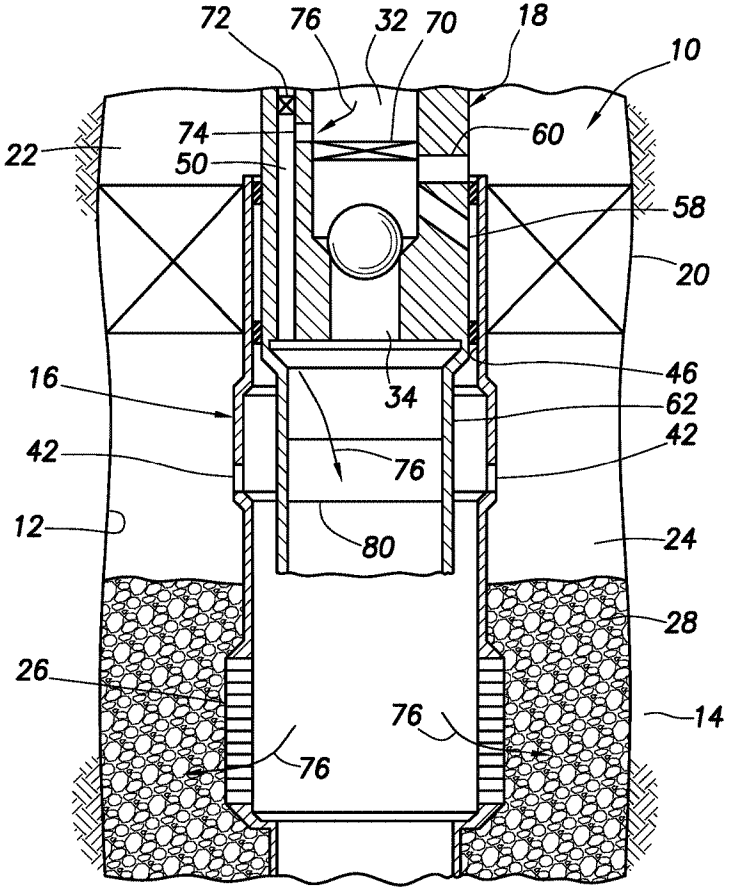

A treatment step is depicted in FIG. 7. This treatment step can be performed after the reverse circulating step of FIG. 6, and before retrieval of the service string 18.

As depicted in FIG. 7, another ball, dart or other plug 70 is installed in the flow passage 32, and then increased pressure is applied to the flow passage. This increased pressure causes a lower section of the flow passage 50 to be isolated from an upper section of the flow passage (e.g., by closing a valve 72), and also causes the lower section of the flow passage 50 to be placed in communication with the flow passage 32 above the plug 70 (e.g., by opening a valve 74). Examples of suitable valve arrangements for use as the valves 72, 74 are described more fully below.

The lower section of the flow passage 50 is, thus, now isolated from the upper annulus 22. However, the lower section of the flow passage 50 now provides for communication between the flow passage 32 and the interior of the well screen 26 via the washpipe 62. Note, also, that the lower annulus 24 is isolated from the upper annulus 22.

A treatment fluid 76 can now be flowed from surface via the flow passages 32, 50 and washpipe 62 to the interior of the well screen 26, and thence outward through the well screen into the gravel 28. If desired, the treatment fluid 76 can further be flowed into the formation 14.

The treatment fluid 76 could be any type of fluid suitable for treating the well screen 26, gravel 28, wellbore 12 and/or formation 14. For example, the treatment fluid 76 could comprise an acid for dissolving a mud cake (not shown) on a wall of the wellbore 12, or for dissolving contaminants deposited on the well screen 26 or in the gravel 28. Acid may be flowed into the formation 14 for increasing its permeability. Conformance agents may be flowed into the formation 14 for modifying its wettability or other characteristics. Breakers may be flowed into the formation 14 for breaking down gels used in a previous fracturing operation. Thus, it will be appreciated that the scope of this disclosure is not limited to use of any particular treatment fluid, or to any particular purpose for flowing treatment fluid into the completion assembly 16.

As depicted in FIG. 7, the valve assembly 80 is again in its open configuration. In this open configuration of the valve assembly 80, the service string 18 can be retrieved from the well, without "swabbing" (decreasing pressure in) the well below the packer 20. The valve assembly 80 can be opened for retrieval of the service string 18, whether or not a treatment operation is performed (e.g., the valve assembly can be opened after the reverse circulation step of FIG. 6, whether or not the treatment fluid 76 is flowed into the well as depicted in FIG. 7).

Although only a single packer 20, well screen 26 and gravel packing operation is described above for the FIGS. 1-7 example, in other examples multiple packers and well screens may be provided, and multiple gravel packing operations may be performed, for respective multiple different zones or intervals of the formation 14 or multiple formations. The scope of this disclosure is not limited to any particular number or combination of any components of the system 10, or to any particular number or combination of steps in the method.

Referring additionally now to FIGS. 8A-D, a cross-sectional view of an example of a treatment tool 82 is representatively illustrated. The treatment tool 82 can incorporate the valves 72, 74 therein when used in the system 10 and method of FIGS. 2-7. In that case, the treatment tool 82 would be connected in the service string 18 above the reversing valve 60. However, it should be appreciated that the treatment tool 82 may be used with other systems and methods, in keeping with the principles of this disclosure.

Figure 8A:
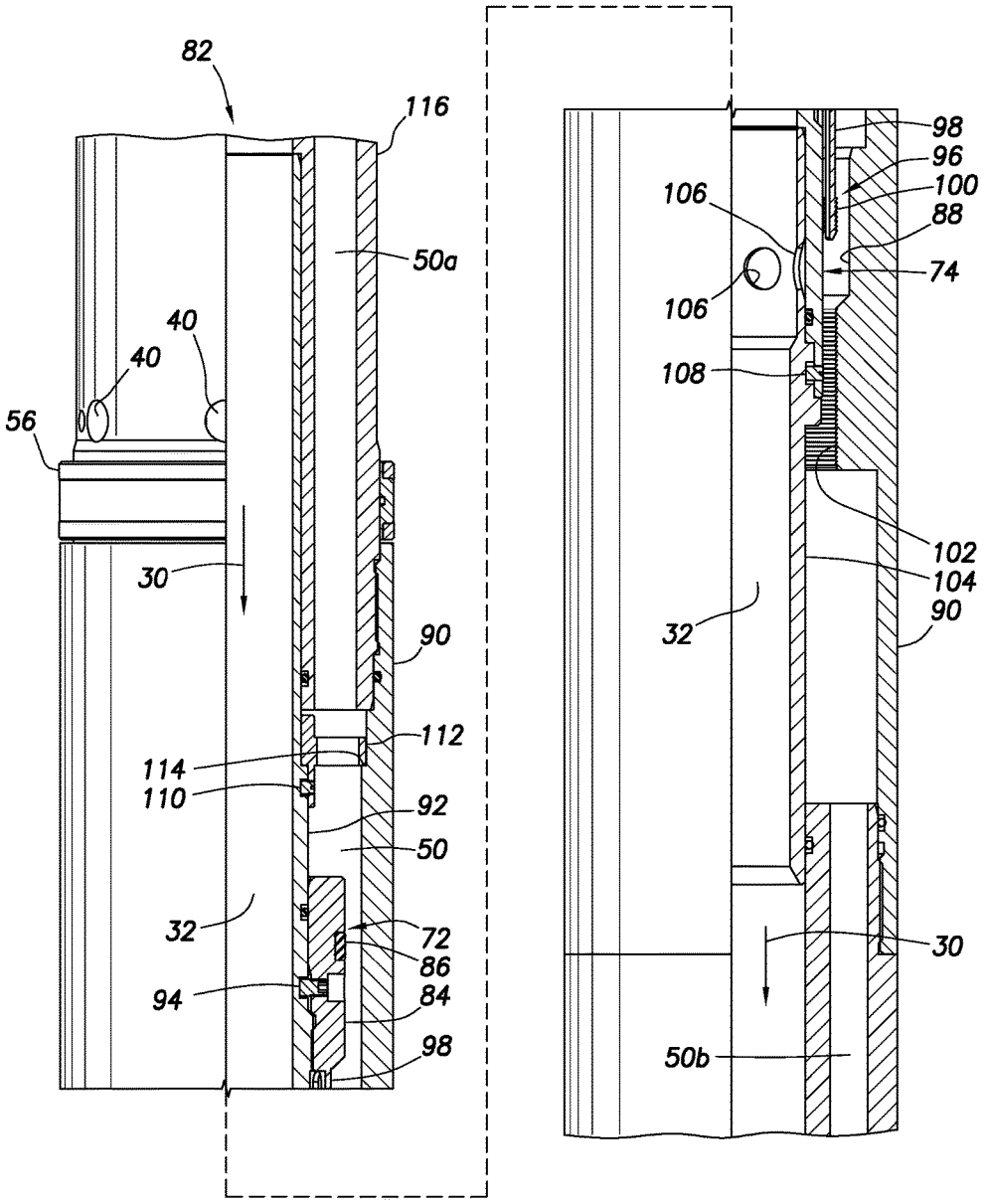
FIGS. 8A-D are representative enlarged scale cross-sectional views of an example of a treatment tool which may be used in the system and method of FIGS. 1-7, the treatment tool being depicted in successive run-in, plugged, partially actuated and fully actuated configurations.

In FIG. 8A, the treatment tool 82 is depicted in a run-in configuration. When used in the system 10, the flow passage 32 extends longitudinally through the treatment tool 82 and, during run-in, the fluid 30 can be circulated through the treatment tool.

In the run-in configuration, the valve 72 is open and permits flow between the upper and lower sections 50*a,b* of the flow passage 50. The valve 74 is closed and prevents flow between the passage 32 and the passage 50.

The valve 72 in this example includes a sleeve 84 and a seal 86 carried thereon. A seal bore 88 formed in an outer generally tubular housing 90 is positioned to sealingly receive the seal 86 therein when the sleeve 84 is displaced downward as described more fully below. The housing 90 may include multiple separate components secured together (such as, by threading, welding, etc.).

An inner generally tubular mandrel 92 is secured to the sleeve 84 (for example, by threading). The mandrel 92 is locked in position relative to the sleeve 84 with a retainer 94 (such as, a set screw).

When the sleeve 84 displaces downward relative to the housing 90, a locking device 96 will prevent subsequent upward displacement of the sleeve 84, as described more fully below. Thus, once the seal 86 has sealingly engaged the seal bore 88, thereby isolating the flow passage upper section 50*a* from the flow passage lower section 50*b*, the upper and lower sections cannot thereafter be placed in communication with each other in the treatment tool 82.

The locking device 96 in the FIGS. 8A-D example includes resilient wickers or collets 98 extending downward from the sleeve 84. The collets 98 have threads or serrations 100 formed externally thereon for gripping engagement with complementarily shaped threads or serrations 102 formed in the housing 90.

The serrations 100, 102 are configured so that the sleeve 84 can displace downwardly relative to the housing 90 before and after the serrations are engaged with each other. However, after the serrations 100, 102 are engaged, upward displacement of the sleeve 84 relative to the housing 90 is prevented. In the FIGS. 8A-D example, the serrations 100, 102 are initially spaced apart from each other and are not engaged, but in other examples the serrations could be engaged in the run-in configuration.

Note that the collets 98 with the serrations 100, and the housing 90 with the serrations 102, provide for "one-way" displacement of the sleeve 84 relative to the housing and, thus, the locking device 96 is a ratchet-type mechanism. However, the scope of this disclosure is not limited to use of ratchet-type locking devices or mechanisms, since other types of devices or mechanisms (such as, snap rings, etc.) may be used to prevent upward displacement of the sleeve 84 relative to the housing 90 after the seal is engaged with the seal bore 88. The scope of this disclosure is not limited to use of any particular types or configurations of devices, mechanisms or elements of the treatment tool 82 as described herein or depicted in the drawings.

The valve 74 in the FIGS. 8A-D example includes a sleeve 104 having openings 106 formed through a sidewall thereof. In FIG. 8A, the valve 74 is closed, with the mandrel 92 overlying the openings 106 and preventing flow through the openings between the passage 32 and the passage 50.

The sleeve 104 is releasably secured against displacement relative to the mandrel 92 by a releasable retainer 108. The retainer 108 is depicted in FIG. 8A as being a shear screw, but other types of releasable retainers may be used in other examples.

The mandrel 92 is secured against displacement relative to the housing 90 by another releasable retainer 110 that extends through a support ring 112. The support ring 112 is confined longitudinally between a shoulder 114 formed in the housing 90 and an upper sub 116. Other ways of releasably securing the mandrel 92 relative to the housing 90 may be used in other examples.

Figure 8B:
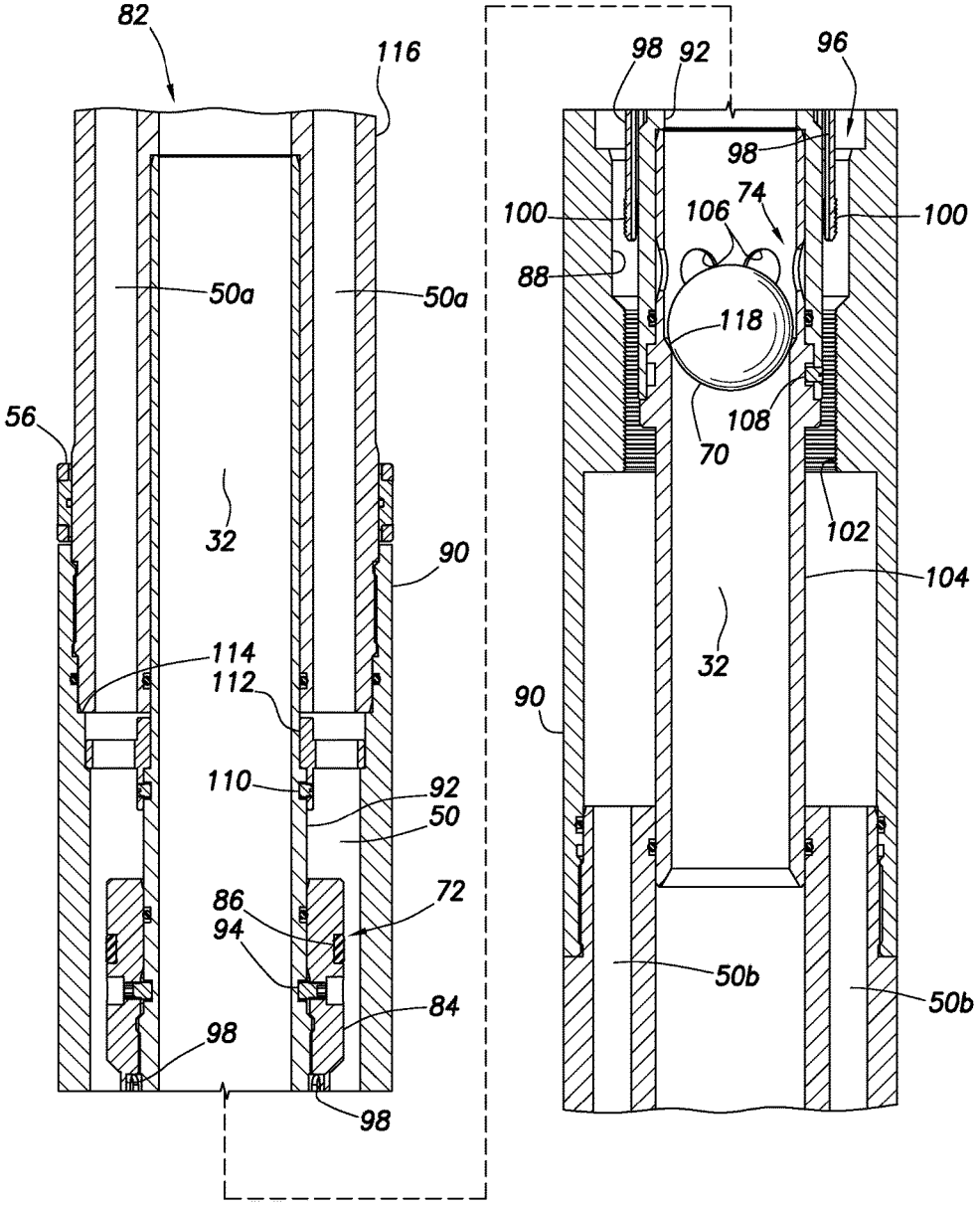

In FIG. 8B, the treatment tool 82 is depicted in a plugged configuration, in which the plug 70 (for example, a ball, dart or other plugging device) is installed in the passage 32. The plug 70 in this example engages a seat 118 formed in the sleeve 104.

A pressure differential can now be created across the plug 70 by applying increased pressure to the passage 32 above the plug (for example, using pumps at the surface). In the system 10 and method of FIGS. 1-7, the plug 70 would be installed, and the pressure differential would be created across the plug, after the reverse circulating step depicted in FIG. 6.

The pressure differential across the plug 70 will result in a downwardly directed force applied to the sleeve 104. This force will be transmitted to the mandrel 92 via the retainer 108, and thence to the support ring 112 via the retainer 110. The downward force is resisted (reacted) by the engagement between the ring 112 and the shoulder 114 in the housing 90, so that the mandrel 92 and the sleeve 104 will displace downward in response to the downward force only when sufficient pressure has been applied to the passage 32 above the plug 70 to cause the retainer 110 to release.

Figure 8C:
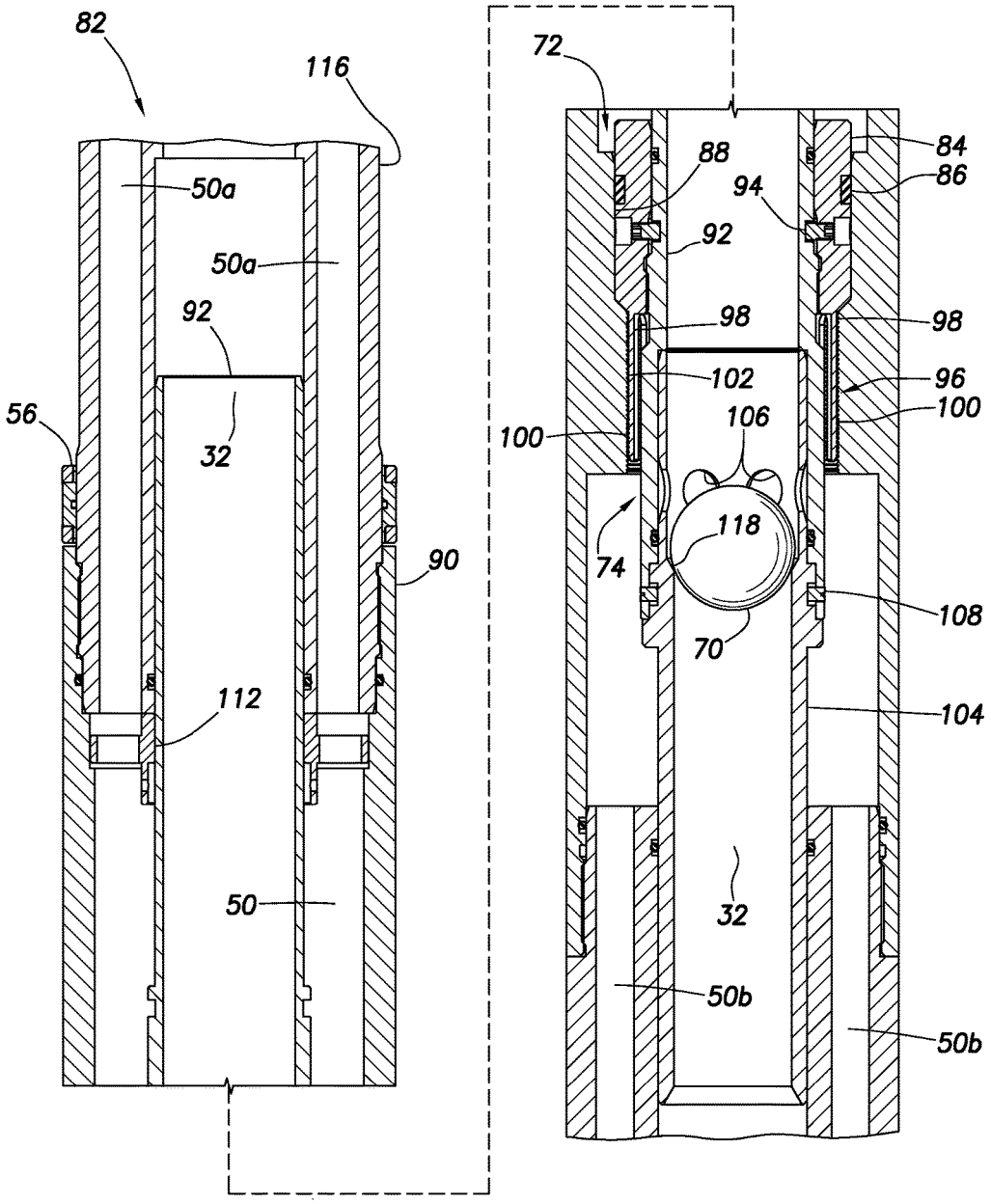

In FIG. 8C, the treatment tool 82 is depicted after the retainer 110 has released, and the mandrel 92 and the sleeve 104 have displaced downward relative to the housing 90. The sleeve 84 remains secured against displacement relative to the mandrel 92 and has, thus, displaced downward with the mandrel and sleeve 104.

The valve 72 is closed, due to sealing engagement of the seal 86 in the seal bore 88. The flow passage upper section 50*a* is now isolated from the flow passage lower section 50*b*. The locking device 96 prevents disengagement of the seal 86 from the seal bore 88.

Pressure applied to the passage 32 above the plug 70 can be further increased to increase the resulting pressure differential across the plug and the downward force applied to the sleeve 104. When the pressure differential and downward force are increased sufficiently, the retainer 108 will release and thereby allow the sleeve 104 to displace downwardly relative to the mandrel 92 and housing 90.

Figure 8D:
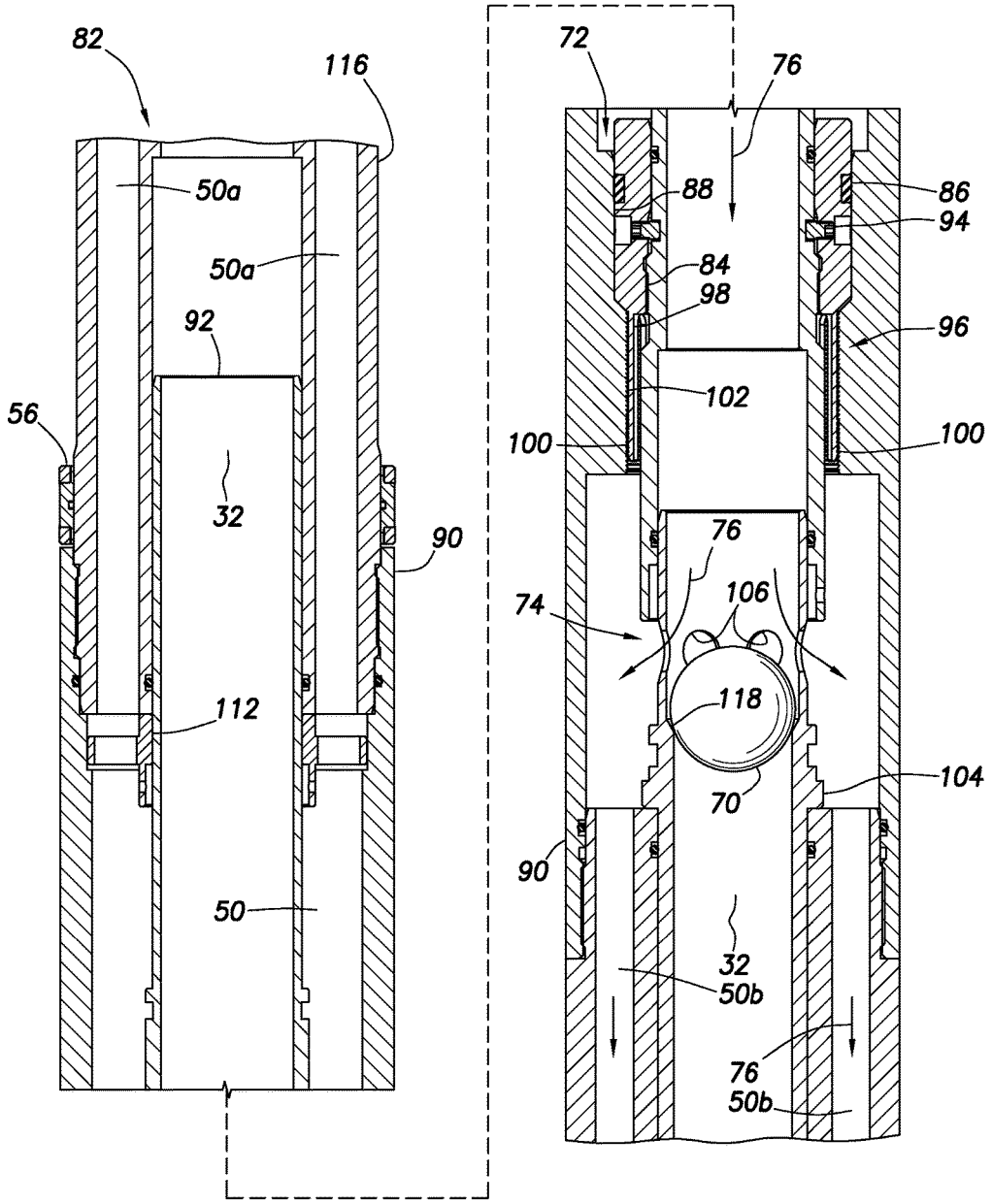

In FIG. 8D, the treatment tool 82 is depicted after the increased pressure differential across the plug 70 has caused the sleeve 104 to displace downwardly relative to the mandrel 92 and housing 90. The valve 74 is now open, and treatment fluid 76 can be flowed from the passage 32 above the plug 70 to the flow passage lower section 50*b*.

When used in the system 10 and method of FIGS. 1-7, this actuated configuration of the treatment tool 82 corresponds to the treatment operation depicted in FIG. 7. The open valve 74 allows the treatment fluid 76 to flow into the completion assembly 16 (for example, into the screen 26 and thence into the gravel 28 in the lower annulus 24, and possibly into the formation 14) via the flow passage lower section 50*b*. The closed valve 72 prevents the treatment fluid 76 from flowing to the upper annulus 22 via the flow passage upper section 50*a*.

Referring additionally now to FIGS. 9A-D, another example of the treatment tool 82 is representatively illustrated. As with the treatment tool 82 of FIGS. 8A-D, the FIGS. 9A-D example incorporates the valves 72, 74 and may be used with the system 10 and method of FIGS. 1-7, or it may be used with other systems and methods.

Figure 9A:
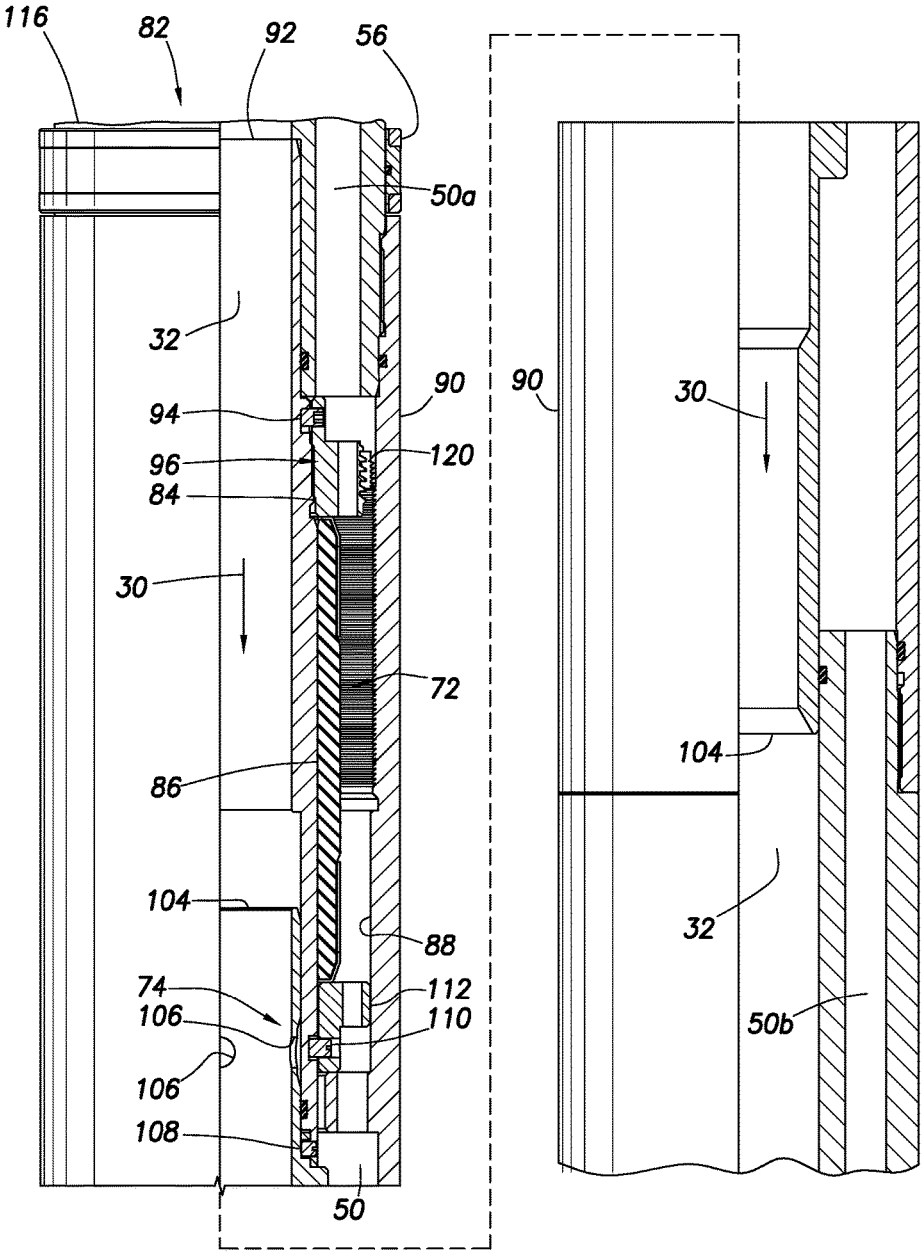
FIGS. 9A-D are representative enlarged scale cross-sectional views of another example of a treatment tool, the treatment tool being depicted in run-in, partially actuated and fully actuated configurations.

In FIG. 9A, the treatment tool 82 is depicted in its run-in configuration. The fluid 30 can be circulated through the flow passage 32 as the completion assembly 16 and service string 18 are installed.

The valve 72 is open, and the valve 74 is closed. The valve 74 of the FIGS. 9A-D example is very similar to that of the FIGS. 8A-D example, in that it includes the openings 106 in the sleeve 104 blocked by the mandrel 92 in its closed configuration.

The valve 72 of the FIGS. 9A-D example, however, is significantly different from that of the FIGS. 8A-D example. As depicted in FIG. 9A, the valve 72 includes the seal 86 in an initial radially retracted condition. To close the valve 72, the seal 86 is radially extended into sealing engagement with the seal bore 88 in response to longitudinal compression, as described more fully below.

The locking device 96 is also significantly different in the FIGS. 9A-D example as compared to the FIGS. 8A-D example. As depicted in FIG. 9A, the locking device 96 includes an internally and externally serrated lock ring 120 interposed radially between the housing 90 and the sleeve 84. The sleeve 84 is externally serrated and does not carry the seal 86 externally thereon, but instead is used for longitudinally compressing the seal, as described more fully below.

Figure 9B:
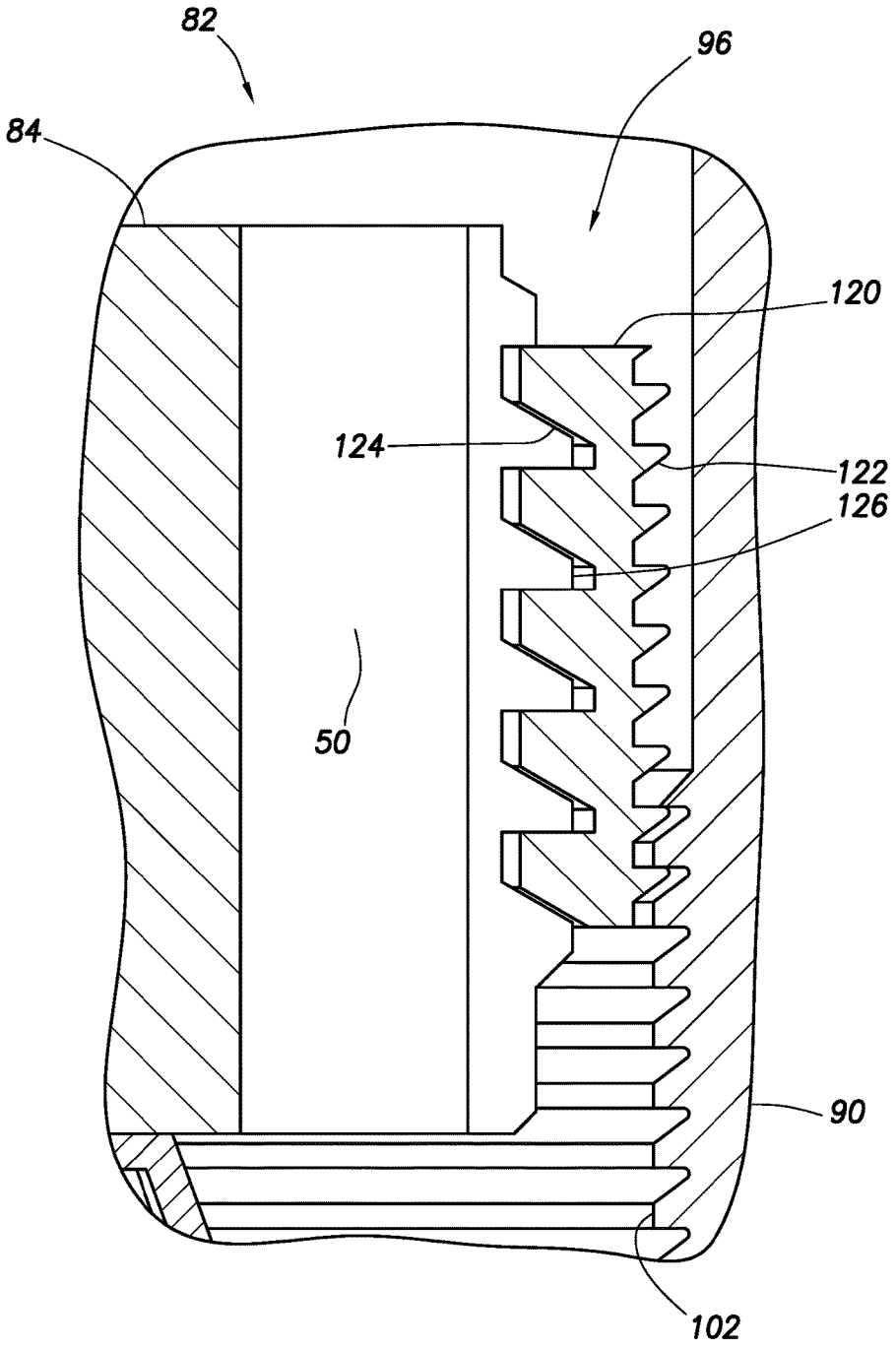

In FIG. 9B, an enlarged scale view of the locking device 96 is representatively illustrated, apart from the remainder of the treatment tool 82. In this view, the manner in which the lock ring 120 is complementarily engaged with both of the sleeve 84 and the housing 90 is more easily seen.

The lock ring 120 is split or "C" shaped, so that it is radially resilient. That is, the lock ring 120 can displace radially between the sleeve 84 and the housing 90. In this example, the lock ring 120 is resiliently biased radially outward, so that relatively fine ramped external serrations 122 on the lock ring will engage the internal serrations 102 in the housing 90. The lock ring 120 also has relatively coarse ramped internal serrations 124 that engage complementarily shaped serrations 126 formed externally on the sleeve 84.

The two sets of serrations 102/122 and 124/126 are appropriately configured (e.g., with mating ramped faces appropriately oriented), so that the lock ring 120 permits the sleeve 84 (and the mandrel 92 connected thereto) to displace downward relative to the housing 90, but prevents upward displacement of the sleeve relative to the housing. Thus, the locking device 96 of FIG. 9B is another example of a "one-way" or ratchet-type mechanism.

Figure 9C:
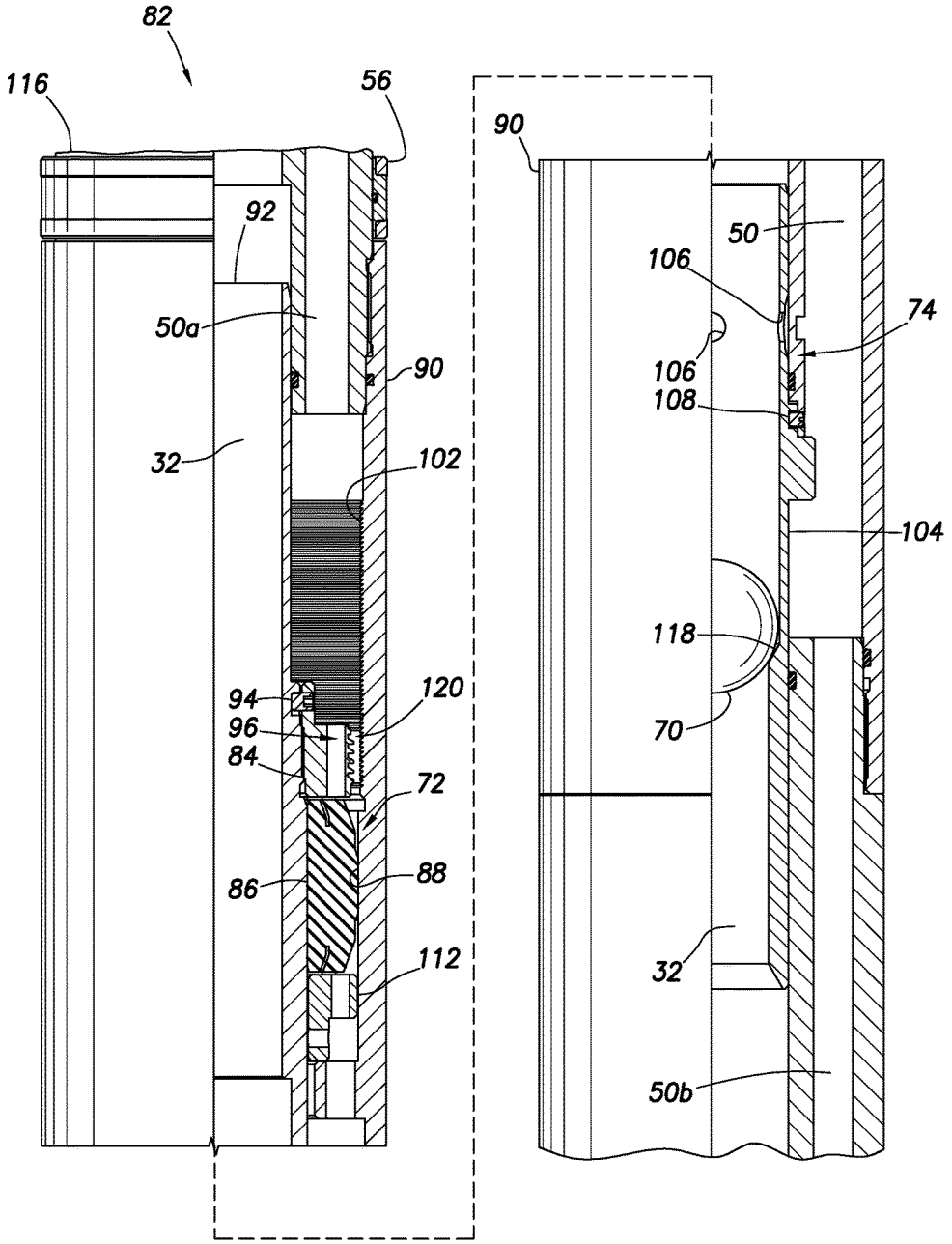

In FIG. 9C, the treatment tool 82 is depicted after the plug 70 has been installed and a sufficient pressure differential has been applied across the plug to cause the retainer 110 to release. The mandrel 92 and the sleeve 104 have displaced downward in response to the downward force resulting from the differential pressure across the plug 70.

Note that the seal 86 has been longitudinally compressed between the sleeve 84 and the support ring 112. The seal 86 now sealingly engages the seal bore 88, thereby closing the valve 72.

Subsequent upward displacement of the sleeve 84 and mandrel 92 is prevented by the locking device 96. Thus, the valve 72 cannot be reopened (since the seal 86 will remain compressed between the sleeve 84 and the support ring 112), although in other examples provisions may be included for reopening the valve.

Figure 9D:
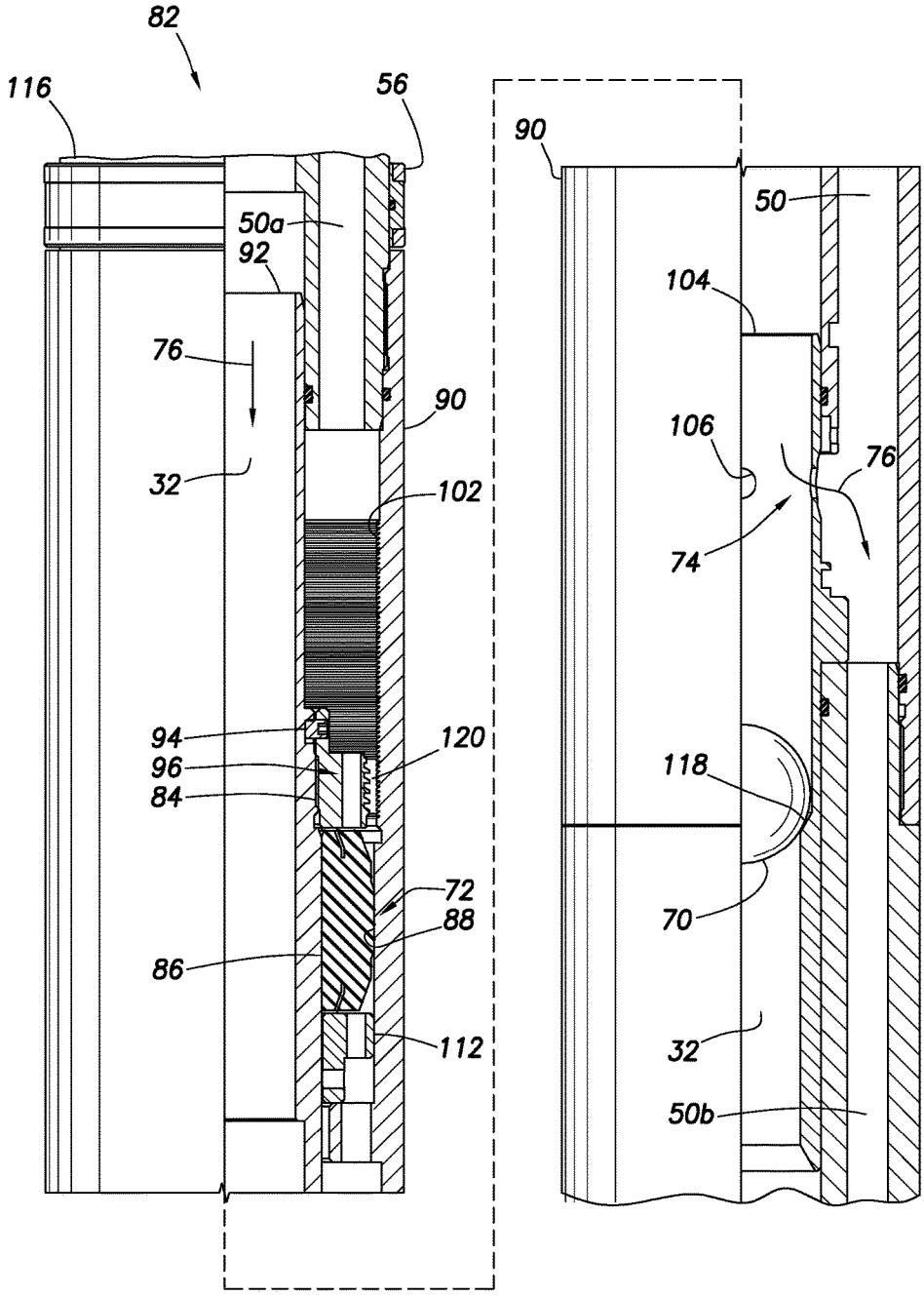

In FIG. 9D, the treatment tool 82 is depicted after a further increased pressure differential is applied across the plug 70, with the increased pressure differential being sufficient to release the retainer 108. The sleeve 104 is now downwardly displaced relative to the mandrel 92, so that the valve 74 is now open.

Treatment fluid 76 can be flowed from the passage 32 above the plug 70 to the flow passage lower section 50*b*. When used in the system 10 and method of FIGS. 1-7, this actuated configuration of the treatment tool 82 corresponds to the treatment operation depicted in FIG. 7.

The open valve 74 allows the treatment fluid 76 to flow into the completion assembly 16 (for example, into the screen 26 and thence into the gravel 28 in the lower annulus 24, and possibly into the formation 14) via the flow passage lower section 50*b*. The closed valve 72 prevents the treatment fluid 76 from flowing to the upper annulus 22 via the flow passage upper section 50*a*.

Referring additionally now to FIGS. 10A-D, another example of the treatment tool 82 is representatively illustrated. As with the treatment tool 82 of FIGS. 8A-9D, the FIGS. 10A-D example incorporates the valves 72, 74 and may be used with the system 10 and method of FIGS. 1-7, or it may be used with other systems and methods.

Figure 10A:
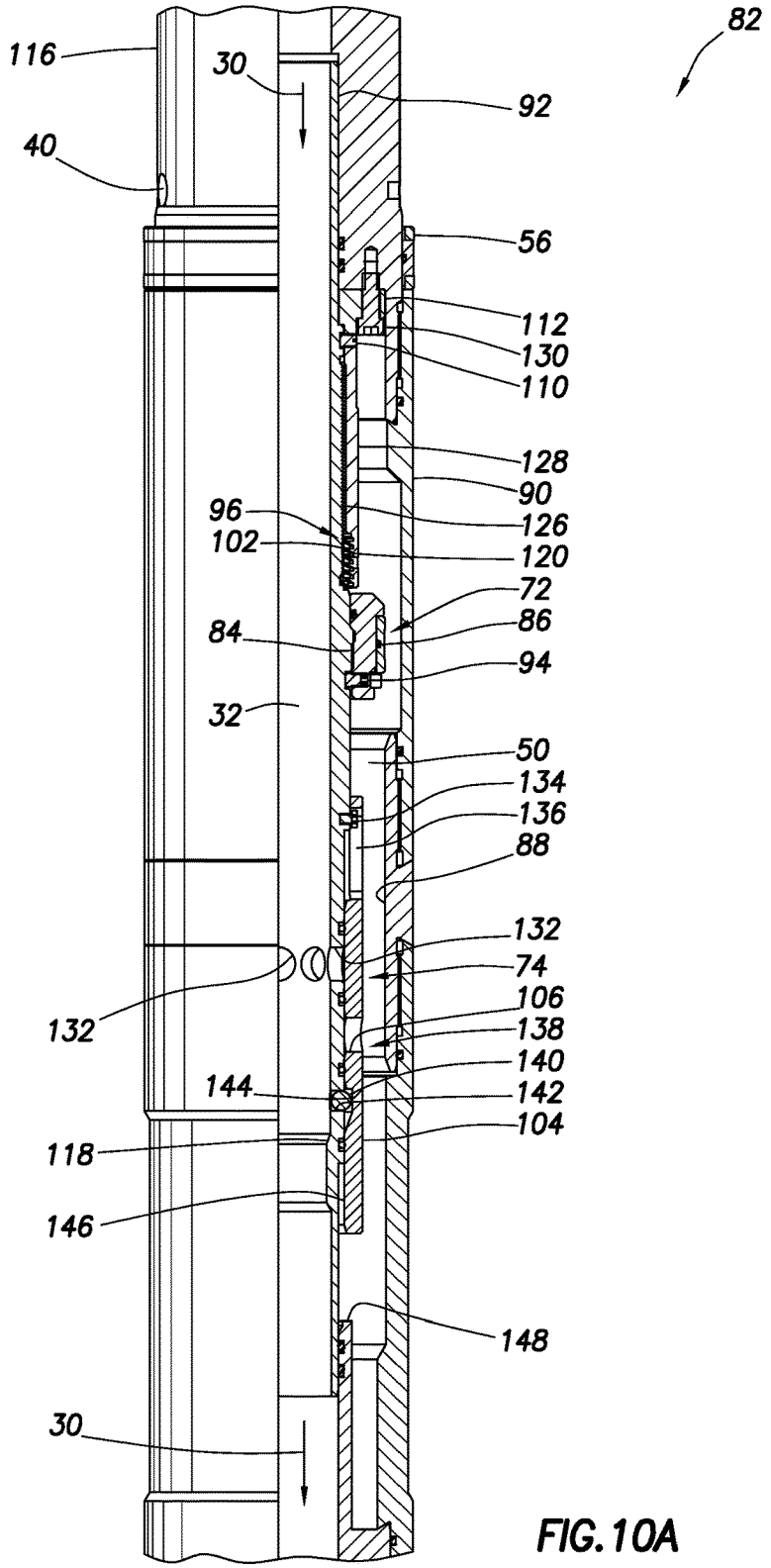
FIGS. 10A-D are representative enlarged scale cross-sectional views of yet another example of a treatment tool, the treatment tool being depicted in run-in, partially actuated and fully actuated configurations.

In FIG. 10A, the treatment tool 82 is depicted in its run-in configuration. The fluid 30 can be circulated through the flow passage 32 as the completion assembly 16 and service string 18 are installed.

The valve 72 is open, and the valve 74 is closed. The valve 74 of the FIGS. 10A-D example is very similar to that of the FIGS. 8A-D example, in that it includes the openings 116 in the sleeve 104 blocked by the mandrel 92 in its closed configuration. However, the sleeve 104 in the FIGS. 10A-D example is carried externally on the mandrel 92.

The locking device 96 is somewhat different in the FIGS. 10A-D example as compared to the FIGS. 9A-D example. The locking device 96 in the FIGS. 10A-D example includes the internally and externally serrated lock ring 120 interposed radially between the mandrel 92 and a lock ring housing 128 extending downwardly from the support ring 112 (which is secured to the upper sub 116 with one or more fasteners 130). The external serrations 126 are formed on the mandrel 92, and the internal serrations are formed in the lock ring housing 128. In this example, the support ring 112 and the lock ring housing 128 are a single component.

Figure 10B:
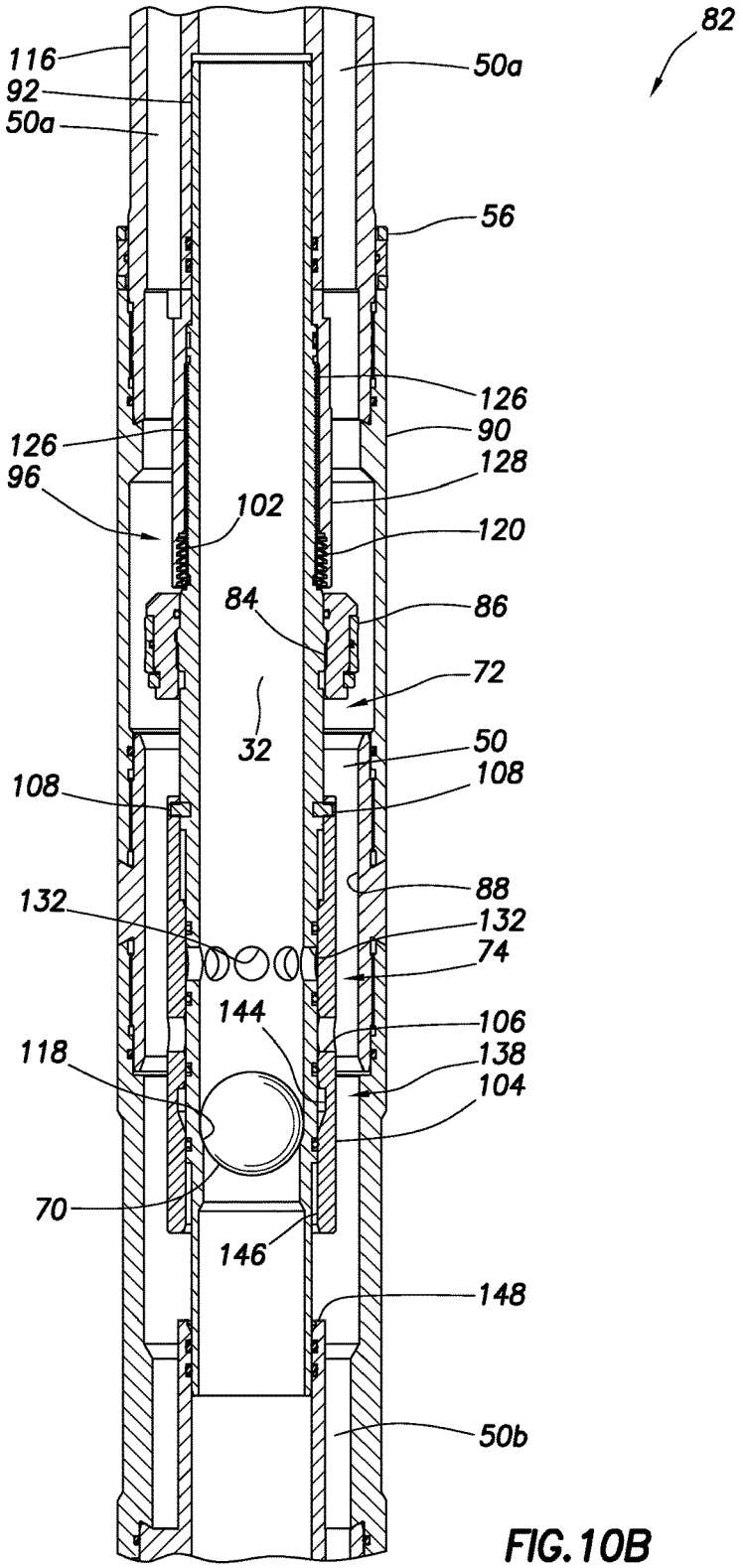

In FIG. 10B, the treatment tool 82 is still in the run-in configuration, but a cross-sectional view is depicted which is rotated somewhat about its longitudinal axis as compared to FIG. 10A. In the view depicted in FIG. 10B, the releasable retainers 108 securing the sleeve 104 relative to the mandrel 92 are visible, as is the upper section 50*a* of the flow passage 50.

Note that the valve 74 includes openings 132 formed through the mandrel 92 above the seat 118. The openings 132 are not in communication with the openings 106 in the sleeve 104 when the valve 74 is in its closed configuration. As depicted in FIG. 10A, rotational alignment between the openings 106, 132 is maintained by one or more fasteners 134 secured to the mandrel 92 and reciprocably engaged with respective longitudinally extending slots 136 formed through the sleeve 104.

Another difference in the example of FIGS. 10A-D is that this example includes a plug retainer 138 for securing the plug 70 in the flow passage 32. The plug retainer 138 prevents the plug 70 from displacing upward through the flow passage 32 in subsequent operations, as described more fully below.

The plug retainer 138 in this example includes radially displaceable retainer members 140 (such as, balls, lugs, dogs, etc.) received in openings 142 formed through the mandrel 92 between the seat 118 and the openings 132. Initially (as in FIGS. 10A-C), the retainer members 140 are radially outwardly disposed and engaged with a radially enlarged annular recess 144 formed in the sleeve 104. Thus, the retainer members 140 do not initially protrude into the flow passage 32.

In FIG. 10B, the plug 70 has been installed in the flow passage 32. The plug 70 sealingly engages the seat 118 below the openings 132 in the mandrel 92. The plug retainer 138 does not prevent the plug 70 from sealingly engaging the seat 118, since the retainer members 140 do not obstruct the flow passage 32 at this point.

Figure 10C:
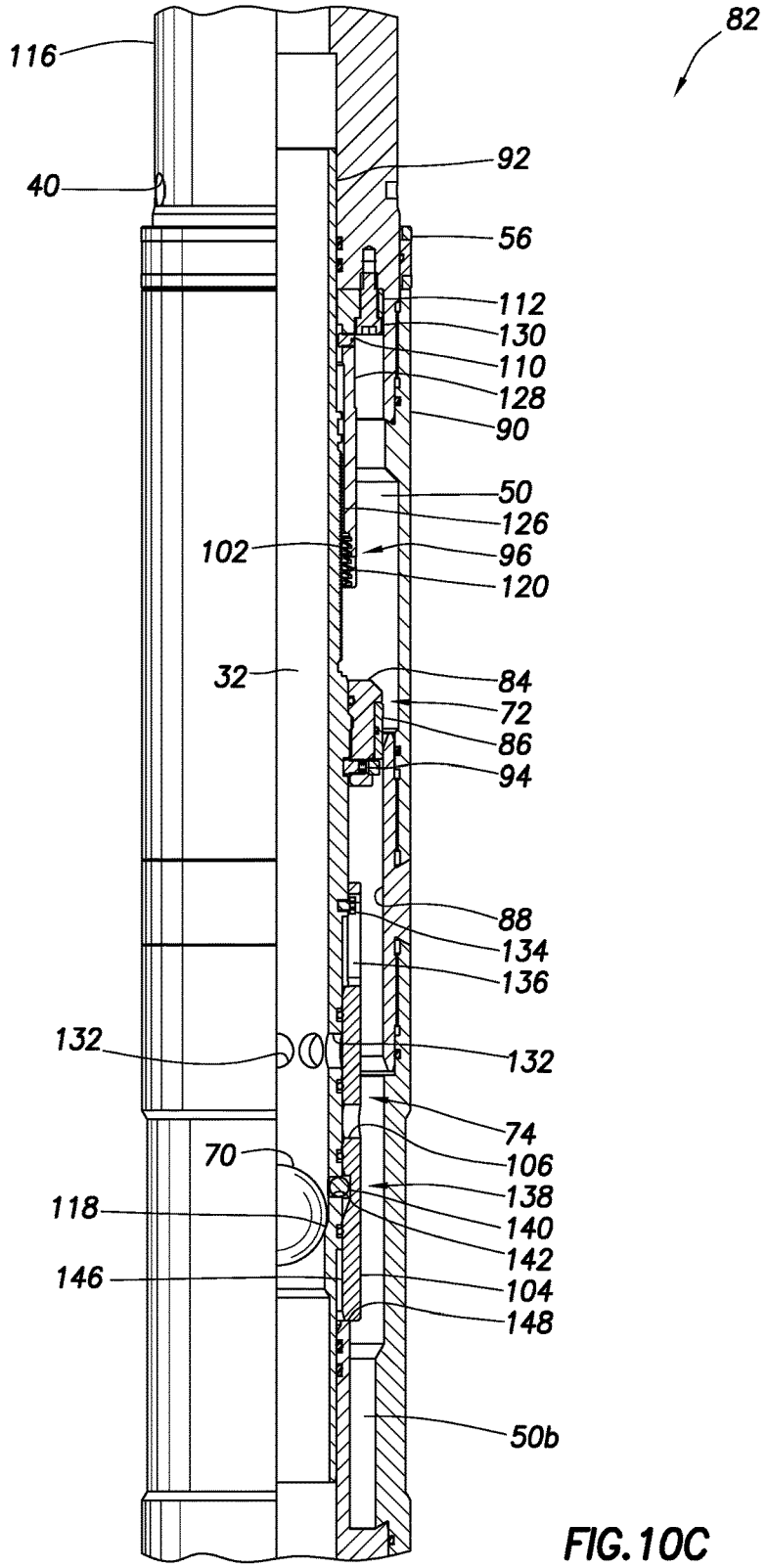

In FIG. 10C, the treatment tool 82 is depicted after a sufficient pressure differential has been applied across the plug 70 to cause the retainer 110 to release. The mandrel 92 and the sleeve 104 have displaced downward in response to the downward force resulting from the differential pressure across the plug 70.

Note that the seal 86 now begins to sealingly engage the seal bore 88, thereby closing the valve 72. The sleeve 104 contacts a support surface 148, thereby preventing further downward displacement of the sleeve.

Subsequent upward displacement of the sleeve 84, seal 86 and mandrel 92 is prevented by the locking device 96. Thus, the valve 72 cannot be reopened, although in other examples provisions may be included for reopening the valve.

Figure 10D:
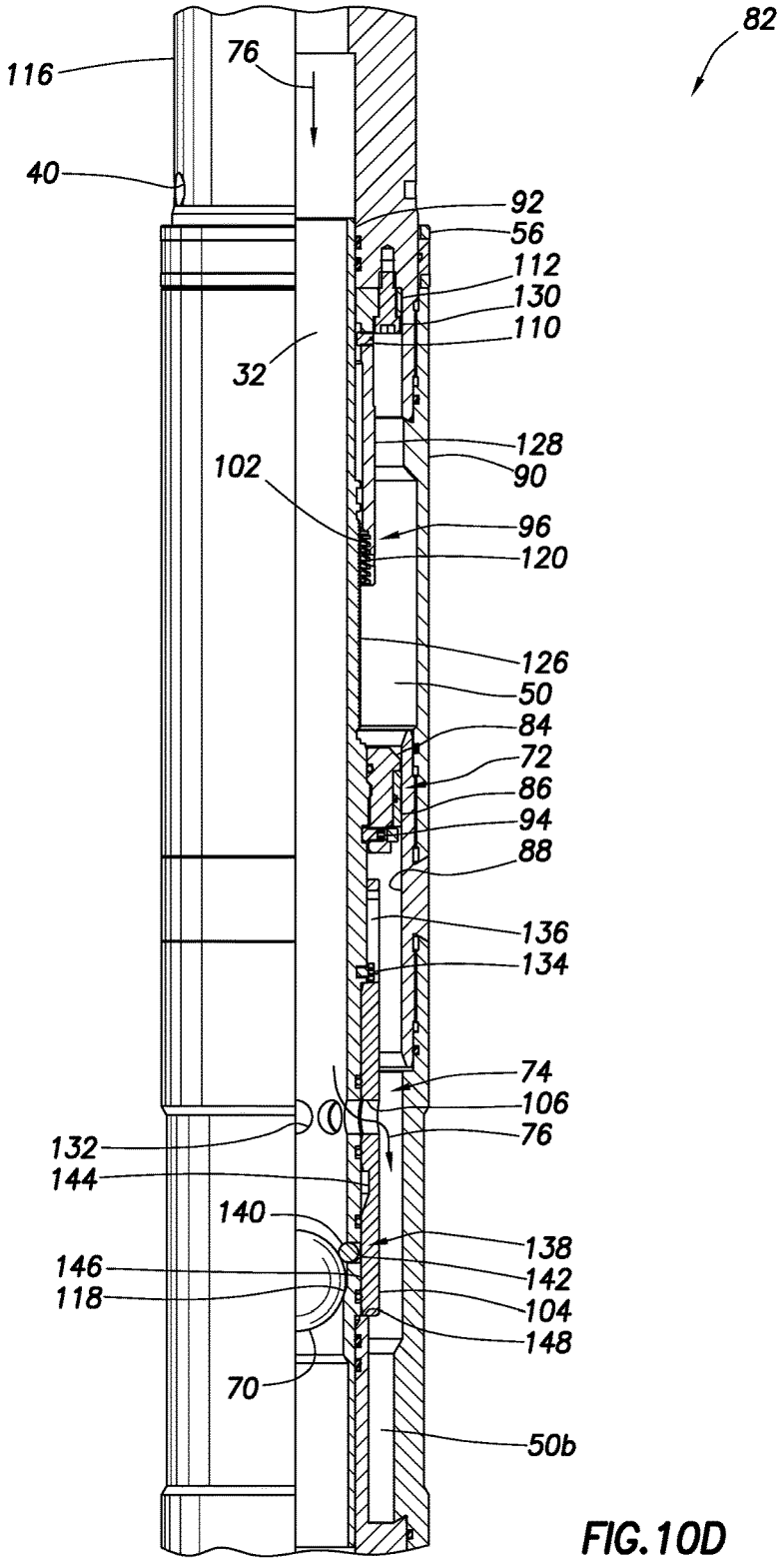

In FIG. 10D, the treatment tool 82 is depicted after a further increased pressure differential is applied across the plug 70, with the increased pressure differential being sufficient to release the retainer 108 (see FIG. 10B). The mandrel 92 is now downwardly displaced relative to the sleeve 104, so that the valve 74 is now open (openings 106, 132 are aligned and in communication with each other).

Treatment fluid 76 can be flowed from the passage 32 above the plug 70 to the flow passage lower section 50*b*. When used in the system 10 and method of FIGS. 1-7, this actuated configuration of the treatment tool 82 corresponds to the treatment operation depicted in FIG. 7.

The open valve 74 allows the treatment fluid 76 to flow into the completion assembly 16 (for example, into the screen 26 and thence into the gravel 28 in the lower annulus 24, and possibly into the formation 14) via the flow passage lower section 50*b*. The closed valve 72 prevents the treatment fluid 76 from flowing to the upper annulus 22 via the flow passage upper section 50*a*.

When the mandrel 92 displaces downward relative to the sleeve 104 and the valve 74 opens, the retainer members 140 are displaced radially inward, so that they now protrude into the flow passage 32 above the seat 118. The retainer members 140 are outwardly supported in this position by an internal portion 146 of the sleeve 104 that is radially reduced relative to the recess 144.

In this position of the retainer members 140, the plug 70 cannot displace upward substantially in the flow passage 32. Therefore, in subsequent operations (e.g., after the treatment operation), if a pressure differential is created from below to above the plug 70, this will not result in substantial upward displacement of the plug through the flow passage 32.

Although, in the above descriptions of the treatment tool 82 examples of FIGS. 8A-10D, a first pressure differential across the plug 70 is used to close the first valve 72, and a second pressure differential across the plug is used to open the second valve 74, it is not necessary for the first and second pressure differentials to comprise different pressure differential levels. For example, the retainer 110 could be selected to release the mandrel 92 for displacement relative to the housing 90 (to thereby close the first valve 72) in response to a selected pressure differential created across the plug 70, and the retainer 108 could be selected to release the sleeve 104 for displacement relative to the mandrel (to thereby open the second valve 74) in response to a combination of the selected pressure differential (or substantially the same pressure differential) and inertial effects due to the mandrel displacement suddenly ceasing while the plug and sleeve can continue to displace downward.

In other examples, the retainer 110 could be selected to release the mandrel 92 for displacement relative to the housing 90 (to thereby close the first valve 72) in response to a combination of inertial effects due to the plug 70 momentum as it engages the seat 118 and a selected pressure differential created across the plug. Thus, the scope of this disclosure is not limited to any particular technique for releasing the mandrel 92 or sleeve 104 for displacement, or to any particular relationship between one or more pressure differentials used to actuate the treatment tool 82 or its valves 72, 74.

It may now be fully appreciated that the above disclosure provides significant advancements to the arts of constructing and utilizing equipment for well operations. In examples described above, the treatment tool 82 provides for control of flow paths for the slurry 64, the slurry fluid 66 and the treatment fluid 76, and can be conveniently operated by installing the plug 70 and applying one or more pressure differentials across the plug.

The above disclosure provides to the art a treatment tool 82 for use with a subterranean well. In one example, the treatment tool 82 can include an outer housing 90 with first and second flow passages 32, 50 extending longitudinally through the outer housing 90, a first valve 72 that, in respective open and closed configurations, selectively permits and prevents flow between first and second sections 50*a,b* of the second flow passage 50, a second valve 74 that selectively prevents and permits flow between the first flow passage 32 and the second section 50*b* of the second flow passage 50, and a locking device 96 that prevents the first valve 72 from being transitioned to the open configuration from the closed configuration.

The locking device 96 may permit displacement of a member (such as, the sleeve 84) of the first valve 72 in a first direction, but prevent displacement of the member of the first valve 72 in a second direction opposite to the first direction. The first and second directions may comprise longitudinal directions. The locking device 96 may permit displacement of the member of the first valve 72 only in the first direction.

The treatment tool 82 may include a mandrel 92 that circumscribes the first flow passage 32, and the locking device 96 may permit displacement of the mandrel 92 in a first longitudinal direction, but prevent displacement of the mandrel 92 in a second longitudinal direction opposite to the first longitudinal direction. A seal 86 of the first valve 72 may engage a seal bore 88 in response to displacement of the mandrel 92 in the first longitudinal direction. The seal 86 may be longitudinally compressed in response to the displacement of the mandrel 92 in the first longitudinal direction.

The treatment tool 82 may include a sleeve 104 of the second valve 74 releasably secured to the mandrel 92, and displacement of the sleeve 104 relative to the mandrel 92 in the first longitudinal direction may cause the second valve 74 to permit flow between the first flow passage 32 and the second section 50*b* of the second flow passage 50. A seat 118 may be disposed in the sleeve 104, and a first pressure differential created across a plug 70 engaged with the seat 118 may cause the mandrel 92 to displace in the first longitudinal direction.

The first pressure differential may cause the first valve 72 to prevent flow between the first and second sections 50*a,b* of the second flow passage 50. A second pressure differential across the plug 70 may cause the sleeve 104 to displace relative to the mandrel 92 in the first longitudinal direction. The second pressure differential may cause the second valve 74 to permit flow between the first flow passage 32 and the second section 50*b* of the second flow passage 50. The second pressure differential may be substantially equal to, or greater than, the first pressure differential.

A seat 118 may extend about the first flow passage 32, and a pressure differential created across a plug 70 engaged with the seat 118 can cause the mandrel 92 to displace in the first longitudinal direction. The treatment tool 82 may include a plug retainer 138 that secures the plug 70 in the first flow passage 32.

The above disclosure also provides to the art a method of treating a subterranean well. In one example, the method can comprise: installing a completion assembly 16 with a service string 18 in the well; setting a packer 20 of the completion assembly 16, thereby separating a first annulus 22 from a second annulus 24, the second annulus surrounding a screen 26 of the completion assembly 16; flowing a first fluid 66 through a first flow passage 32 of the service string 18 and into the second annulus 24, the first fluid 66 entering the screen 26 and flowing to the first annulus 22 via a second flow passage 50 of the service string 18; then installing a plug 70 in the first flow passage 32, thereby preventing flow through the first flow passage 32 to the second annulus 24; and creating at least one pressure differential across the plug 70, thereby preventing flow from an interior of the screen 26 to the first annulus 22 and permitting flow from the first flow passage 32 to the interior of the screen.

The "at least one" pressure differential can comprise first and second pressure differentials, the first pressure differential causing flow to be prevented from the interior of the screen 26 to the first annulus 22, and the second pressure differential causing flow to be permitted from the first flow passage 32 to the interior of the screen 26.

The step of preventing flow from the interior of the screen 26 to the first annulus 22 may be performed prior to the step of permitting flow from the first flow passage 32 to the interior of the screen 26.

The method can include flowing a second fluid 76 through the service string 18 and from the first flow passage 32 to the interior of the screen 26. The second fluid 76 may be a treatment fluid. The treatment fluid 76 may comprise an acid or other type of fluid.

The step of preventing flow from the interior of the screen 26 to the first annulus 22 may include a locking device 96 preventing a first valve 72 from transitioning from a closed configuration to an open configuration. The locking device 96 may maintain a seal 86 of the first valve 72 engaged with a seal bore 88. The locking device 96 may maintain a longitudinal compression of the seal 86.

The step of permitting flow from the first flow passage 32 to the interior of the screen 26 may comprise opening a second valve 74. The step of preventing flow from the interior of the screen 26 to the first annulus 22 may comprise closing the first valve 72 by displacing a mandrel 92 relative to an outer housing 90, the mandrel 92 circumscribing the first flow passage 32, and the step of opening the second valve 74 may comprise displacing a sleeve 104 relative to the mandrel 92.

The method may include securing the plug 70 in the first flow passage 32, thereby restricting displacement of the plug 70 through the first flow passage 32.

A system 10 for use with a subterranean well is also described above. In one example, the system 10 can comprise a completion assembly 16 including a packer 20 and a screen 26, the packer separating a first annulus 22 from a second annulus 24 surrounding the screen; and a service string 18 engaged with the completion assembly 16, the service string including a treatment tool 82 with first and second flow passages 32, 50 extending longitudinally through the treatment tool. A plug 70 in the first flow passage 32 prevents flow through the service string 18 from the first flow passage 32 to the second annulus 24, a first valve 72 of the treatment tool 82 prevents flow through the second flow passage 50 from an interior of the screen 26 to the first annulus 22, and a second valve 74 of the treatment tool 82 permits flow from the first flow passage 32 to the interior of the screen 26 through the second flow passage 50.

A locking device 96 of the treatment tool 82 may prevent the first valve 72 from being transitioned from a closed configuration to an open configuration. The locking device 96 may prevent disengagement of a seal 86 of the first valve 72 from a seal bore 88. The locking device 96 may prevent the seal 86 from being longitudinally decompressed.

The service string 18 may include a plug retainer 138 that secures the plug 70 in the first flow passage 32. The plug retainer 138 may include retainer members 140 that displace radially inward in response to opening of the valve 74.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A treatment tool for use with a subterranean well, the treatment tool comprising:

an outer housing with first and second flow passages extending longitudinally through the outer housing;

a first valve that, in respective open and closed configurations, selectively permits and prevents flow between first and second sections of the second flow passage;

a second valve that selectively prevents and permits flow between the first flow passage and the second section of the second flow passage; and a locking device that prevents the first valve from being transitioned to the open configuration from the closed configuration.

2. The treatment tool of claim 1, wherein the locking device permits displacement of a member of the first valve in a first direction, but prevents displacement of the member of the first valve in a second direction opposite to the first direction.

3. The treatment tool of claim 2, wherein the first and second directions comprise longitudinal directions.

4. The treatment tool of claim 2, wherein the locking device permits displacement of the member of the first valve only in the first direction.

5. The treatment tool of claim 1, further comprising a mandrel that circumscribes the first flow passage, and wherein the locking device permits displacement of the mandrel in a first longitudinal direction, but prevents displacement of the mandrel in a second longitudinal direction opposite to the first longitudinal direction.

6. The treatment tool of claim 5, wherein a seal of the first valve engages a seal bore in response to displacement of the mandrel in the first longitudinal direction.

7. The treatment tool of claim 6, wherein the seal is longitudinally compressed in response to the displacement of the mandrel in the first longitudinal direction.

8. The treatment tool of claim 5, further comprising a sleeve of the second valve releasably secured to the mandrel, and wherein displacement of the sleeve relative to the mandrel in the first longitudinal direction causes the second valve to permit flow between the first flow passage and the second section of the second flow passage.

9. The treatment tool of claim 8, wherein a seat is disposed in the sleeve, and wherein a first pressure differential created across a plug engaged with the seat causes the mandrel to displace in the first longitudinal direction.

10. The treatment tool of claim 9, wherein the first pressure differential causes the first valve to prevent flow between the first and second sections of the second flow passage.

11. The treatment tool of claim 9, wherein a second pressure differential across the plug causes the sleeve to displace relative to the mandrel in the first longitudinal direction.

12. The treatment tool of claim 11, wherein the second pressure differential causes the second valve to permit flow between the first flow passage and the second section of the second flow passage.

13. The treatment tool of claim 11, wherein the second pressure differential is substantially equal to, or greater than, the first pressure differential.

14. The treatment tool of claim 5, wherein a seat extends about the first flow passage, wherein a pressure differential created across a plug engaged with the seat causes the mandrel to displace in the first longitudinal direction, and further comprising a plug retainer that secures the plug in the first flow passage.

* * * * *